US006142545A

United States Patent [19]

Penman et al.

[11] Patent Number: 6,142,545

[45] Date of Patent: Nov. 7, 2000

[54] CASING PUSHDOWN AND ROTATING TOOL

[75] Inventors: Andrew Robert Penman; Peter John Lovegrove, both of Lowestoft, United Kingdom

[73] Assignee: BJ Services Company, Houston, Tex.

[21] Appl. No.: 09/191,360

[22] Filed: Nov. 13, 1998

[51] Int. Cl.[7] ..... E21B 31/18

[52] U.S. Cl. ..... 294/86.15; 294/86.12; 294/86.17; 294/86.28

[58] Field of Search ..... 294/86.1, 86.12, 294/86.15, 86.17, 86.19, 86.2, 86.26, 86.28, 102.2; 166/98, 99, 371, 381, 243

[56] References Cited

U.S. PATENT DOCUMENTS

| | | | |
|---|---|---|---|
| 1,823,340 | 9/1931 | Vance | 294/86.15 |
| 2,123,036 | 7/1938 | Bozeman | 294/86.2 |
| 2,373,081 | 4/1945 | Salverda | 294/86.28 |
| 2,507,127 | 5/1950 | True | 294/86.17 |
| 2,980,464 | 4/1961 | Poteet | 294/86.17 |
| 3,393,002 | 7/1968 | Woolley | 294/86.3 |
| 4,585,369 | 4/1986 | Manesse | 294/86.15 |

FOREIGN PATENT DOCUMENTS

| | | | |
|---|---|---|---|
| 1452-930 | 1/1989 | U.S.S.R. | 294/86.26 |

OTHER PUBLICATIONS

Figure for "Casing Pushdown Tool Assembly" by BJ Tubular Services (Jan. 16, 1995).

*Primary Examiner*—Dean J. Kramer
*Attorney, Agent, or Firm*—Howery Simon Arnold & White, LLP

[57] ABSTRACT

A pushdown and rotating tool for holding, pushing, and rotating a floated casing string into a wellbore is provided. The tool includes a mandrel, a housing attached about the external diameter of the mandrel and shaped to receive a collared casing, a jaws assembly within the housing, and an automatic hydraulics system for actuating the jaws. The mandrel and housing are connected such that they can move telescopically relative to one another, and such motion actuates the jaws. The tool has a threaded coupling for a top drive connection, the top drive providing the pushdown and rotational forces which are transmitted to the casing by way of the tool. The mandrel also has an internal passage-way through its length and a male connection at the bottom. The tool facilitates floating a casing into a substantially horizontal wellbore when the casing becomes buoyant and tries to "kick back" out of the well, or when the floated casing becomes stuck and requires rotation to extend beyond the obstacle.

16 Claims, 3 Drawing Sheets

CASING PUSHDOWN AND ROTATING TOOL

BACKGROUND OF THE INVENTION

1. Field of the Invention

This invention relates generally to the field of oil and gas field drilling and casing, and, more particularly, to a tool for pushing and rotating a casing that is being floated into a wellbore. The casing pushdown and rotating tool is particularly effective in floating a casing into a horizontal or extended reach wellbore.

2. Description of the Related Art

The field of drilling sometimes requires pushing casing into substantially horizontal wells. This becomes necessary when, for example, a formation sought to be tapped into using a well is in a location that cannot be reached from a substantially vertical well because of the potential adverse environmental impact associated with drilling from a position directly above the formation, or because increased production is possible from a horizontal or extended reach wellbore. When it is necessary to insert casing into a substantially horizontal well, for example, inserting a casing into a well that extends vertically only a few thousand feet from the surface but extends several thousand feet horizontally, the casing is sometimes pushed. When the wellbore is of substantial length, the frictional forces associated with pushing the casing as it lays on the bottom of the wellbore become significant, to the point where it becomes necessary to try something else to continue the progression of the casing string. One such method used to extend the reach of the casing into the well is to hold the casing off the bottom of the well. This is possible with a procedure called floating. When a casing is floated into a well it is held off the bottom of the casing by floating on a fluid, usually drilling mud, which is already in the wellbore. The casing is run into the well empty, and as it is inserted into the mud-filled well, a buoyancy force keeps the casing floating off the bottom of the well. It is then easier to push the long casing string to the bottom of the well. However, the buoyancy of the casing can also present a problem. In some wells the casing has a tendency to "kick back" and come out of the wellbore because of the buoyancy force created as the casing is inserted into the wellbore. For this reason there is a need to hold and push the casing as it is being inserted into the wellbore.

In addition, sometimes during the insertion of the casing, the casing may become stuck and can be very difficult or impossible to dislodge and continue to advance through the wellbore by simply pushing. This happens because the wellbore is not a perfectly straight hole for the length of the well. The horizontal section of a well naturally has small peaks, valleys, twists, and turns that the casing can often get hung up and stuck on as it is floated into the hole. Current methods of dislodging a stuck casing include rotation of the casing using a water bushing. The rotation of the casing while concurrently advancing the casing causes a corkscrew effect, which often frees the stuck casing. The installation and use of a water bushing, however, requires significant amounts of time and money. Until the present invention, there was no way to allow holding, pushing, and rotation of the casing without a time consuming and expensive interruption of the lowering of the casing into the wellbore to install a water bushing.

A water bushing is connected to the top drive via a drill pipe or pup joint and then in turn connected to the casing string hanging in the wellbore. The top drive rotation mechanism is used to rotate the complete casing string. This method has both cost and safety implications, i.e. the casing operation has to be halted while the water bushing is fitted to the top drive and casing string. During that period, which can take up to one hour, it is possible that because of the lack of movement the casing will become completely stuck and thus a well intervention method might have to be deployed to release the casing. In such a circumstance several days can be lost. There is also a safety concern associated with installing a water bushing. If the casing is stuck at a high point above the rig floor, then a person in a riding belt has to negotiate the water bushing makeup high above the floor, creating a safety risk.

The present invention is directed to overcoming, or at least reducing the effects of, one or more of the problems set forth above.

SUMMARY OF INVENTION

The present invention is directed to a pushdown and rotating tool for floating a casing string into a wellbore. The invention is particularly suited for use with a top drive drilling system. In one aspect of the present invention a hollow mandrel is attached to a movable housing that comprises multiple jaws in order to secure a casing and facilitate holding, pushing and rotating the casing. The housing is connected by multiple splines to the mandrel about the external diameter of the mandrel and a self-contained hydraulic system actuates the jaws around the casing when the casing exerts a force on the tool. This tool is designed to be in place, centered above the casing being floated into a wellbore, automatically operating when a casing "kicks back" out of the wellbore. The force of the casing "kicking back" actuates the jaws of the tool, which grab the casing and secure it in place. The tool can then be used to push and rotate the casing back into the wellbore. The pushing and rotational forces are provided by a top drive to which the tool is connected. Once the casing has been pushed and rotated into the wellbore and there is no longer a force transmitted against the tool, the jaws automatically retract back into the housing and the tool is repositioned for insertion of another joint of casing.

According to one embodiment of the present invention, a device for pushing and rotating casings comprises a mandrel, a housing attached about the external diameter of the mandrel, the housing configured on its lower end to receive a casing, a plurality of jaws within the housing, and a means for actuating the jaws to grip the casing. The means for actuating the jaws may be automatically activated upon relative movement between the mandrel and the housing. Likewise, the means for actuating the jaws may be automatically deactivated upon relative movement in the opposite direction between the mandrel and the housing. The relevant movement between the mandrel and the housing is caused by the force exerted by the casing. Upon release of the force exerted by the casing, the jaws are retracted from the casing, thereby releasing the housing from the casing. According to one embodiment, the housing is connected to the mandrel by a plurality of splines extending along the length of the mandrel.

According to one embodiment of the present invention, the means for actuating the jaws is a closed hydraulic system. The hydraulic system may be self contained within the mandrel and the housing. According to one embodiment, the hydraulic system comprises a push cylinder in hydraulic communication with a jaws cylinder for each of the plurality of jaws. The hydraulic system may include a relief valve to prevent exertion of a force in excess of the specified minimum yield stress of the casing.

In another embodiment of the present invention, the means for actuating the jaws is a pneumatic system. The pneumatic system may comprise a means to prevent exertion of a force in excess of the specified minimum yield stress of the casing. Alternatively, the means for actuating the jaws may be an electrical system. The electrical system further comprises a means to prevent exertion of force in excess of the specified minimum yield stress of the casing.

According to one embodiment of the push down and rotating device, the mandrel is adapted to be connected to a top drive. The top drive provides weight to exert force on the casing and the means for rotating the casing. The housing of the device may include a tapered guide on its lower end to facilitate the entry of the casing into the housing.

BRIEF DESCRIPTION OF THE DRAWINGS

Other objects and advantages of the invention will become apparent upon reading the following detailed description and upon reference to the drawings in which.

Figure 1:
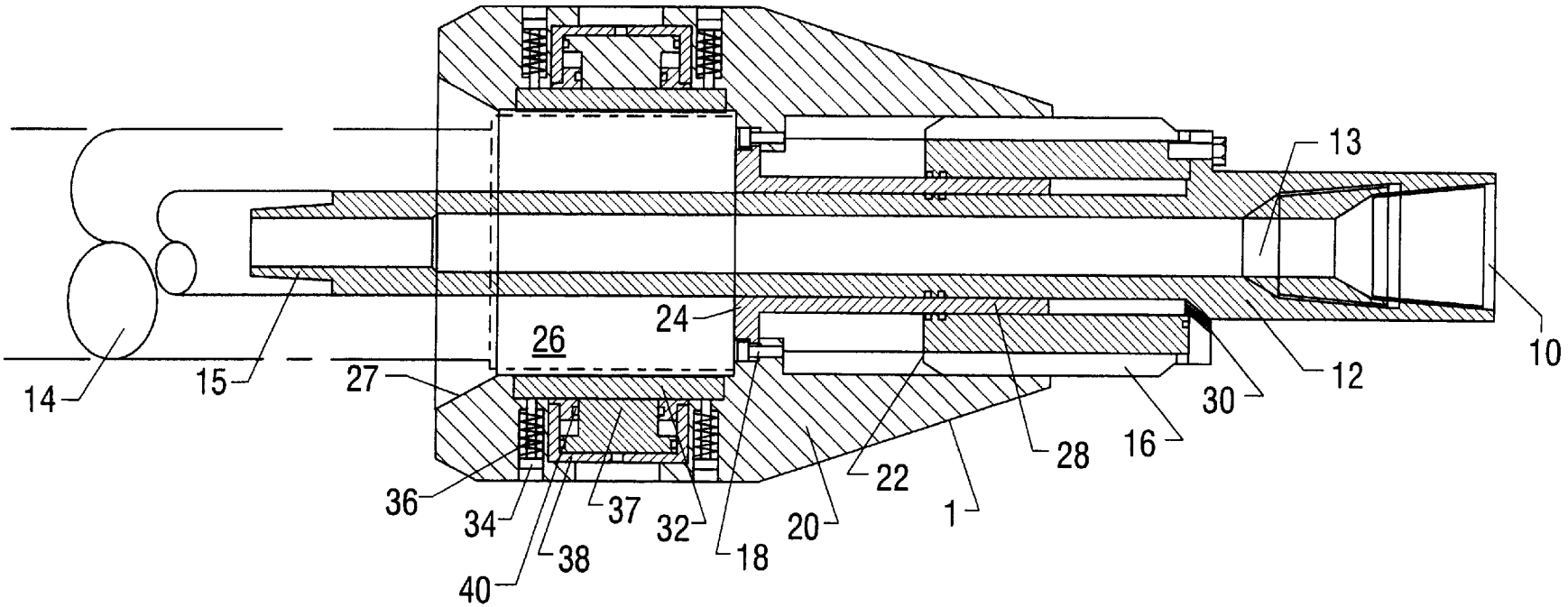
FIG. 1 depicts a crossection of the pushdown and rotating tool in accordance with one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Figure 4:
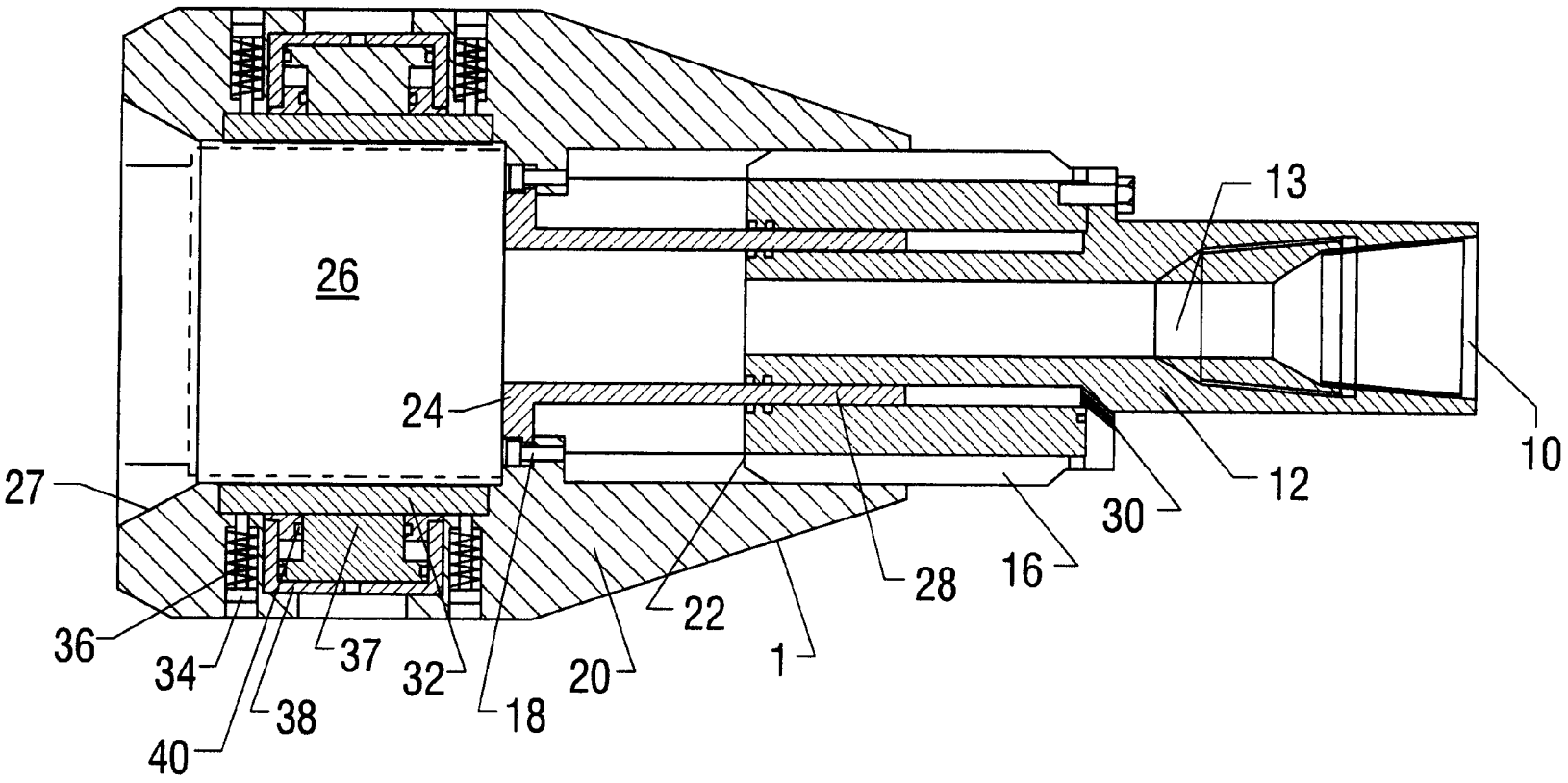
FIG. 4 depicts a crossection of another embodiment of the pushdown and rotating tool.

Turning now to the drawings, and in particular to FIG. 1, a preferred embodiment of the pushdown and rotating tool (1) is illustrated in accordance with the present invention. Beginning at the top of the tool a threaded coupling (10) for connecting with a top drive is shown disposed within a mandrel (12) that is made of steel or other common oil field material. It will be understood that a spacer sub or the like may be positioned between the top drive and the present invention. The mandrel (12) includes a passageway (13) therethrough, said passageway providing for the introduction of drilling mud or other substances into and through the tool and then into the casing (14) as needed. The mandrel in a preferred embodiment extends through the length of the tool and ends with a male connection (15) for attachment of a hose or other tool as necessary. In an alternative embodiment the mandrel does not extend through the entire length of the tool but instead terminates approximately halfway through the tool as shown in FIG. 4. Further along the mandrel are a plurality of splines (16) and retaining bolts (18), for example four splines and retaining bolts, whereby the housing (20) is attached to the mandrel (12) about the external diameter of the mandrel (12). The splines (16) allow for relative movement between the housing (20) and the mandrel (12) upon the application of force upon either. For example, the mandrel (12) and the housing (20) may move in a concentric and longitudinal manner relative to each other for a distance of several inches. The relative movement between the mandrel (12) and the housing (20) is limited by a shoulder (22) toward the top of the tool, and a plurality of retaining bolts (18) toward the bottom of the tool.

In one embodiment, the application of force causing relative movement between the mandrel (12) and the housing (20) is transmitted via a baffle plate (24), which is connected to the bottom of push cylinder (28) and the housing (20) by the retaining bolts (18). The lower portion of the housing (20) provides a recess (26) into which the casing collar for the casing (14) will enter when the buoyant force overcomes the downward gravitational force on the casing (14) and comes back out of the wellbore. The recess (26) is formed by the internal wall of the housing (20) and extends from the chamfer (27) to the baffle plate (24). Preferably, the longitudinal length of the recess (26) equals or exceeds the length of the casing collar the tool is designed to stab over. The housing (20) is chamfered around the bottom inner circumferential surface (27) to guide the casing into the recess (26) as the casing comes out of the wellbore.

Figure 3:
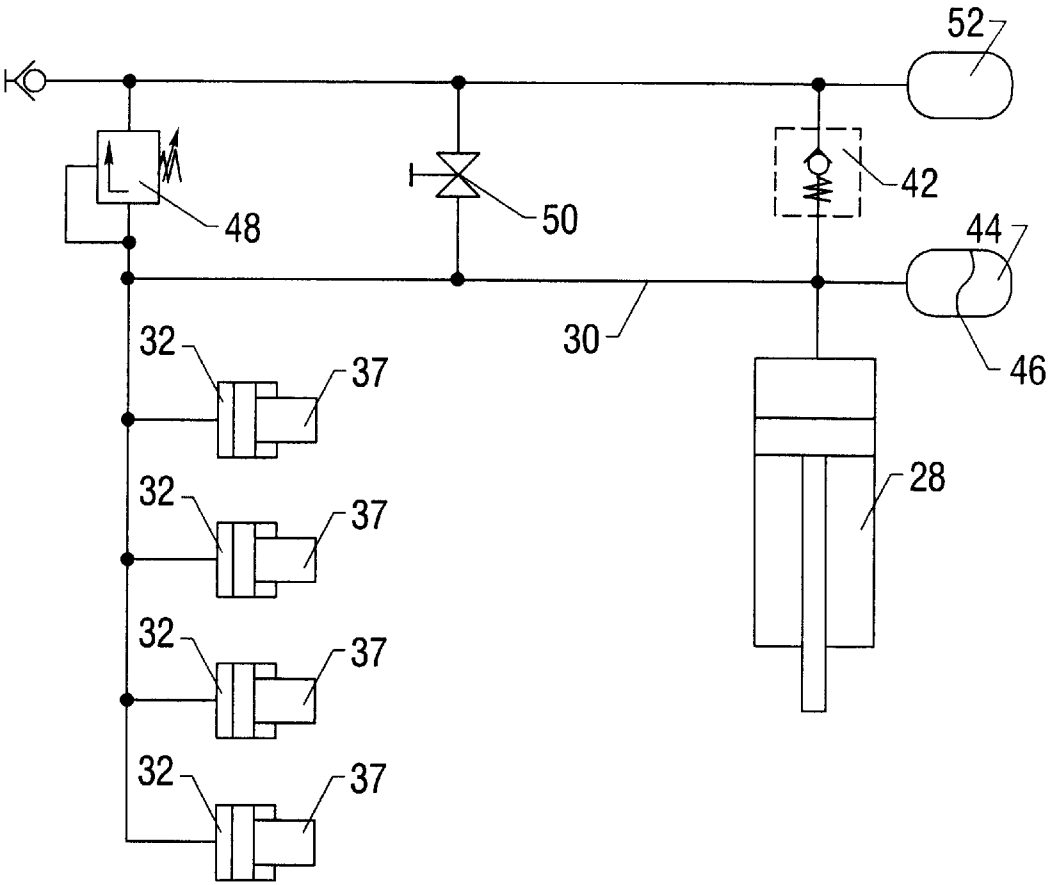
FIG. 3 is a schematic diagram of the self-contained hydraulic system for actuation of the jaws.

The preferred embodiment also includes a hydraulic system completely contained within the mandrel (12) and housing (20) combination. FIG. 3 illustrates the hydraulic system contained within the pushdown and rotating tool (1). A push cylinder (28) within the mandrel (12) and a flow duct (30) extending through the mandrel (12) and the housing (20) are shown.

As depicted in FIG. 1, the pushdown and rotating tool includes a plurality of jaws (32) within the housing (20) with which the tool can grip and secure the casing (14) upon activation. The jaws (32) are connected to the housing by a plurality of bolts (34). Each bolt extends through a spring (36) whose tendency is to retract the jaws (32) away from the surface of the casing collar and into the housing (20). The jaws (32) include a plurality of teeth for gripping the casing, and adjacent to each of the jaws in a radially outward direction is a jaws cylinder (37). The jaws cylinders (37) are in fluid communication with the push cylinder (28) located in the mandrel. When actuated, the jaws cylinders move radially inward forcing the jaws (32) into engagement with the casing collar. The cylinders are each adjacent to a fluid chamber (38) which are in fluid communication with the fluid ducts (30). The hydraulic system may utilize hydraulic fluid comprising oil or other common oil field fluids.

Figure 2:
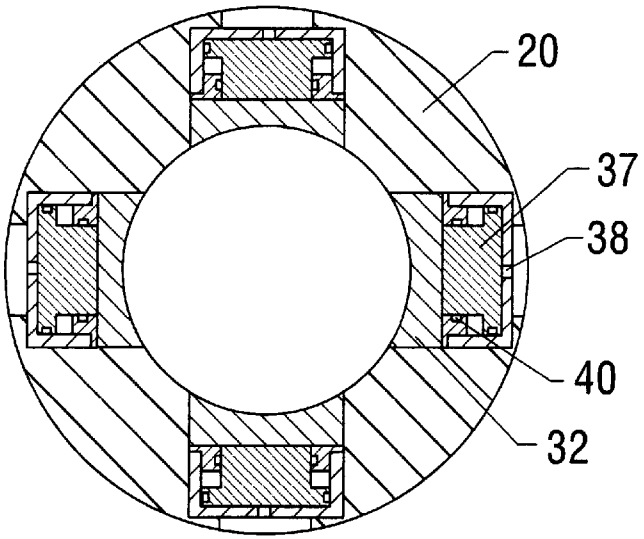
FIG. 2 depicts a top view of the housing and jaws assembly.

FIG. 2 shows a top view of the housing/jaws assembly. The jaws (32) are illustrated in the retracted position which allows the pushdown and rotating tool to be stabbed over a joint of casing. In a preferred embodiment, the pushdown and rotating tool includes four sets of jaws. It will be understood, however, that the number of jaws may vary for a given tool. Preferably, the jaws are spaced an equal distance about the internal diameter of the housing (20) to evenly distribute the gripping force. Adjacent to the jaws (32) are the jaws cylinders (37), which are located in a radially outward position relative to the jaws. The cylinders (37) are actuated by hydraulic fluid chambers (38) and are limited in travel toward the center of the assembly by a retainer (40). When actuated, the jaws move in a radially inward direction toward the center of the assembly, coming into contact with the collar of the casing (14).

FIG. 3 shows a schematic for a means of jaws actuation, more particularly, an internally closed system of hydraulics is depicted. In a preferred embodiment, the internally closed system herein described operates automatically, which is of particular advantage in terms of safety. Manual operation of the tool is not required. Once the tool is in place, the tool is self-actuating, independent from any human intervention. The push cylinder (28), when activated, initiates fluid displacement from the cylinder, through the ducts (30), and to the jaws cylinders (37) which force the jaws (32) radially inward into engagement with the casing. The hydraulics include an accumulator (44) with a bladder (46), and behind the bladder is a pressurized inert gas such as nitrogen. The accumulator (44) provides fluid to the closed system. Downstream from push cylinder (28) is a relief valve (48) strategically set to prevent overpressure of the hydraulic system and subsequent yielding of the casing. For example the relief valve may be set at 70% of the yield strength of the casing (14) to ensure relief of pressure occurs before the casing collar collapses. By way of further example, the relief valve for a 9 ⅝" casing may be set at 8000 psi. There is also a bleed off valve (50) and a pressurized reservoir (52) whereby an immediate release of the pressure under any circumstance and a corresponding retraction of the jaws (32) into the housing (20) can be made. The check valve (42) allows only unidirectional fluid flow from the reservoir as the system requires replenishment of hydraulic fluid.

Alternative means of jaws actuation could be used as well. For example the hydraulics system described previously could be replaced by a similar pneumatic system for operation of the cylinders.

Another alternative means of jaws actuation could be electric, wherein the movement between the housing (20) and the mandrel (12) could stimulate an electric transducer sensitive to movement or pressure which in turn would send a signal to an electric motor. Upon receipt of he signal, the electric motor initiates movement of the jaws in a radially inward direction to engage with the collar of the casing in a manner similar to the hydraulic system.

Operation of the pushdown and rotating tool of FIGS. 1–3 may be illustrated as follows. A casing string, for example a 9 ⅝" or 10 ¾" casing, is being floated into a wellbore. As the casing string is assembled, it is lowered into the wellbore through the rotary table of a drilling rig. The uppermost joint of casing in the string is lowered to and supported in the rotary table by the flush mounted spider slips. A new joint of casing is picked up and connected to the casing string suspended in the rotary table. The new joint of casing is suspended from casing elevators and is positioned below the pushdown and rotation tool. The tool (1), being connected to the top drive, is centered directly above the joint. The casing string is picked up and the flush mounted spider slips are released. When the floating casing string attempts to "kick back" and come out of the wellbore, the new joint of casing enters the recess (26) of the tool until it reaches a position where the end of the casing collar rests against the baffle plate (24). The application of force by the casing due to buoyancy is exerted on the baffle plate (24) and initiates movement of the housing relative to the mandrel. The movement is communicated through the push cylinder (28) of the hydraulic system causing the push cylinder to displace fluid through the ducts (30) to the fluid chambers (38). The corresponding increase in fluid pressure causes the jaws cylinders (37) to move radially toward the center of the tool, forcing the jaws (32) radially inward into engagement with the casing (14). As the force exerted by the casing onto the baffle plate (24) increases, there is a corresponding increase in pressure communicated to the hydraulic system. The increased pressure and displacement in the hydraulic system translates to more movement of the jaws cylinders (37) toward the casing (14) and a more secure hold on the circumferential surface of the casing collar within the housing. The cycle of an increasing force from the end of the casing which is transmitted to the baffle plate, leading to movement of the housing relative to the mandrel, which initiates more pressure in the hydraulic system, which in turn tightens the grip of the jaws on the circumferential surface of the casing, would potentially have no limit unless there was a relief in the hydraulic system. For this reason the relief valve (48) is set at a predetermined pressure level to release pressure above a certain limit, for example 8000 psi, to avoid allowing the jaws (32) to exert a force that is in excess of the specified minimum yield strength of the casing.

In the alternative embodiment of the pushdown and rotating tool wherein the jaws are electrically actuated, the electric motor has preset force application limits such that the jaws will apply forces not in excess of the yield strength of the collared casing. When the force from the casing subsides, the transducer then sends another signal which reverses the motor and releases the jaws to retract back into the housing.

With the casing held by the jaws, the casing can no longer "kick back", and the casing can be rotated and/or pushed by means of a top drive. The top drive is connected to the tool by the threaded coupling (12). The top drive typically weighs in excess of 35 tons and this weight can be transferred through the tool to push the casing string into the wellbore. The top drive may be actuated to rotate the tool and the casing string. The tool is capable of holding the casing while withstanding substantial torque, for example of 20,000 ft-lbs, to accommodate the desired rotation. The slow rotational movement is intended to facilitate continued insertion of the casing into the wellbore and overcome current problems of floated casings becoming stuck in a wellbore.

Once the casing string has been pushed and rotated down the wellbore using the tool, the slips in the flush mounted spider are closed in the rotary table of the drilling rig. The casing is then supported in the rotary table and the force transmitted from the end of the casing onto the tool subsides. As the force decreases, the push cylinder (28) automatically relaxes to its original position and reduces the force exerted by jaws cylinders (37). Subsequently, jaws (32) retract into the housing (20), with the aid of springs (36), thereby releasing the casing (14). The next joint of casing can then be added to the string as described supra.

FIG. 4 is an alternative embodiment in which the mandrel terminates approximately half way through the tool. This tool would therefore be somewhat shorter than the embodiment shown in FIG. 1. The embodiment in FIG. 4 is intended to show just one of many possible alternative embodiments of the present invention.

It will be understood that the housing can be sized to be used on a range of casing sizes, for example a housing might be sized to accommodate casing of both 9 ⅝" and 10 ¾" O.D. Additionally there may be various housings made to accommodate much smaller or much larger casings. These housings would be interchangeable with the mandrel to cover a larger range of sizes, for example a single mandrel might be compatible with housings that can push, hold, and rotate casings ranging from 20" to 13 ⅜", 10 ¾" to 9 ⅝", and/or 7 ⅝" to 4 ½". However, there may also be pushdown and rotating tools with housings permanently adapted to specific casing sizes.

While the present invention has been particularly shown and described with reference to various illustrative embodiments thereof, it will be understood by those skilled in the art that various changes in form and details may be made without departing from the spirit and scope of the invention. The above-described embodiments are illustrative and should not be considered as limiting the scope of the present invention.

What is claimed is:

1. A device for pushing and rotating casing comprising:

a mandrel;

a housing attached about the external diameter of the mandrel, the housing having an internal recess to receive a casing;

a plurality of jaws within the housing; and a means for actuating the jaws to grip the casing wherein the application of torque to the device will be transferred to the casing;

wherein the means for actuating the jaws is activated upon relative movement between the mandrel and housing and wherein the relative movement between the mandrel and the housing is caused by a force exerted by the casing.

2. The device of claim 1, wherein the means for actuating the jaws is deactivated upon relative movement in the opposite direction between the mandrel and housing.

3. The device of claim 1, wherein the jaws are automatically retracted upon release of the force exerted by the casing.

4. The device of claim 1, wherein the housing is connected to the mandrel by a plurality of splines extending along the length of the mandrel.

5. The device of claim 1, wherein the means for actuating the jaws is a pneumatic system.

6. The device of claim 1, further comprising a means to prevent the jaws from exerting a force in excess of the specified minimum yield stress of the casing.

7. The device of claim 1, wherein the mandrel is adapted to be connected to a top drive, the top drive providing a weight to be transferred through the device to exert force on the casing and a means for rotating the casing.

8. The device of claim 1, wherein the mandrel has a threaded coupling for connecting to a top drive and an internal passage-way extending through the length of the mandrel.

9. The device of claim 1, wherein the housing includes a tapered guide on its lower end.

10. A device for pushing and rotating casing comprising:

a mandrel;

a housing attached about the external diameter of the mandrel, the housing having an internal recess to receive a casing;

a plurality of jaws within the housing; and a means for actuating the jaws to grip the casing;

wherein the means for actuating the jaws is a closed hydraulic system.

11. The device of claim 10, wherein the hydraulic system is self contained within the mandrel and housing.

12. The device of claim 11, wherein the hydraulic system comprises a push cylinder in hydraulic communication with a jaws cylinder for each of the plurality of jaws.

13. The device of claim 12, wherein the hydraulic system further comprises a relief valve to prevent exertion of force by the jaws in excess of the specified minimum yield stress of the casing.

14. A device for pushing and rotating casing comprising:

a mandrel;

a housing attached about the external diameter of the mandrel, the housing having an internal recess to receive a casing;

a plurality of jaws within the housing; and a means for actuating the jaws to grip the casing, wherein the casing may be rotated by rotation of the device;

wherein the means for actuating the jaws is activated by a force exerted by the casing.

15. The device of claim 14, wherein the means for actuating the jaws is automatically deactivated upon release of the force exerted by the casing.

16. The device of claim 14, further comprising a means to prevent exertion of force by the jaws in excess of the specified minimum yield stress of the casing.

* * * * *